US008540825B2

(12) United States Patent
Hwang et al.

(10) Patent No.: US 8,540,825 B2
(45) Date of Patent: Sep. 24, 2013

(54) LOW-TEMPERATURE STAINLESS STEEL CARBURIZATION METHOD

(75) Inventors: Kuen-Shyang Hwang, Taipei (TW); Li-Hui Cheng, Taipei (TW); Yung-Chung Lu, Taoyuan County (TW)

(73) Assignee: Taiwan Powder Technologies Co., Ltd., Daxi Town, Taoyuan County (TW)

( * ) Notice: Subject to any disclaimer, the term of this patent is extended or adjusted under 35 U.S.C. 154(b) by 253 days.

(21) Appl. No.: 13/074,742

(22) Filed: Mar. 29, 2011

(65) Prior Publication Data

US 2012/0247620 A1 Oct. 4, 2012

(51) Int. Cl.
*C23C 8/22* (2006.01)
*C22C 38/18* (2006.01)
*C22C 38/36* (2006.01)

(52) U.S. Cl.
USPC ..... 148/235; 148/225; 148/324; 148/325; 420/11; 420/43

(58) Field of Classification Search
USPC ..... 148/225, 235, 325; 420/11, 43
See application file for complete search history.

(56) References Cited

U.S. PATENT DOCUMENTS 5,556,483 A 9/1996 Tahara et al.
5,593,510 A 1/1997 Tahara et al.
5,792,282 A 8/1998 Tahara et al.
6,093,303 A 7/2000 Williams et al.
6,217,679 B1 * 4/2001 Kohno et al. ..... 148/636
6,461,448 B1 10/2002 Williams et al.
6,547,888 B1 4/2003 Williams et al.
7,468,107 B2 12/2008 Tipps et al.

OTHER PUBLICATIONS

Tsujikawa, M., et al. "Effect of molybdenum on hardness of low-temperature plasma carburized austenitic stainless steel." Surface and Coatings Technology 201.9 (2007): 5102-5107.*

* cited by examiner

*Primary Examiner* — Jesse Roe
(74) *Attorney, Agent, or Firm* — Muncy, Geissler, Olds & Lowe, PLLC

(57) ABSTRACT

A low-temperature stainless steel carburization method comprises steps: providing a stainless steel material; placing the stainless steel material in a halogen-free reducing environment and maintaining the stainless steel at a first temperature ranging 1,050 to 1,400° C.; and placing the stainless steel material in a carbon-bearing atmosphere and maintaining the stainless steel material at a second temperature lower than 600° C. to implant carbon atoms into the stainless steel material to form a carburized layer on the surface of the stainless steel material. A halide-bearing gas or solution is not to be applied to activate the passivation layer, so the fabrication cost would be reduced and the safety of carburization process would be enhanced. Besides, the environment can be prevented from halide pollution.

7 Claims, 6 Drawing Sheets

LOW-TEMPERATURE STAINLESS STEEL CARBURIZATION METHOD

FIELD OF THE INVENTION

The present invention relates to a low-temperature stainless steel carburization method, particularly to a method implanting carbon atoms into the surface of stainless steel to achieve high hardness without using a halide-bearing atmosphere.

BACKGROUND OF THE INVENTION

According to the crystallographic structures, the stainless steels can be categorized into the austenitic type, the martensitic type, and the ferritic type. Stainless steels have superior corrosion resistance and are suitable to be used in structures or decorative surfaces, such as screws, nuts, shafts, pins, decorative accessories, and the casings of watches, mobile phones, electronic products and electric appliances. However, the surface mechanical properties of the traditional stainless steels are usually unable to meet application requirements. For example, 316L stainless steel, a designation of AISI (American Iron and Steel Institute), contains 15-18 wt % Cr, 12-15 wt % Ni, 2-3 wt % Mo, and the balance of iron and impurities. 316L stainless steel has a hardness of HRB50-70, and the surface thereof is likely to be damaged by abrasion or collision.

A nitriding method or a carburizing method is usually used to increase the concentration of carbon or generate nitride in the surface of a stainless steel workpiece so as to promote the surface mechanical properties. The carburizing method is particularly extensively used in the industry. Normally, stainless steel is carburized in a carbon-bearing atmosphere at a specified temperature for a long time. Thereby, carbon atoms can implant into the surface of a workpiece to form a carburized layer. In a U.S. Pat. No. 7,468,107, a stainless steel workpiece is carburized in a methane-bearing atmosphere at a temperature of 1,900-2,000° F. At such a high temperature (over 980° C.), the chromium in stainless steels is likely to react with carbon in the atmosphere. Thus, the amount of dissolved chromium in the surface of the stainless steel workpiece decreases, and the corrosion resistance of the stainless steel workpiece is degraded. Accordingly, the carburizing temperature of 316L stainless steel workpiece is preferred to be below the temperature of the nose in the continuous cooling transformation (CCT) diagram shown in FIG. 1.

The surface of the stainless steel workpiece usually has a passivation layer hindering implantation of carbon atoms and impairing formation of a carburized layer when carburization is undertaken at a temperature below the nose temperature. Therefore, the passivation layer should be removed before low-temperature carburization. U.S. Pat. Nos. 5,792,282, 5,556,483, and 5,593,510 disclosed a carburization method for austenitic stainless steel, wherein stainless steel is placed in a fluorine- or fluoride-bearing atmosphere at a temperature of 250-450° C. for tens of minutes to convert the passivation layer into a fluorinated layer. Next, stainless steel is carburized at a temperature of 400-500° C. Carbon atoms can more easily pass through the fluorinated layer than the passivation layer containing chromium oxide. Thus, the carburized depth may reach about 20 μm, and the hardness may reach about HV800, in the abovementioned prior arts.

A U.S. Pat. No. 6,547,888 disclosed modified low temperature case hardening processes, wherein stainless steel is placed in an $N_2$ atmosphere containing 20 vol % HCl at a temperature of 550° F. for 60 minutes to activate the passivation layer. Then, the stainless steel is carburized at a temperature of 880-980° F. In addition, U.S. Pat. Nos. 6,461,448 and 6,093,303 disclosed other low temperature case hardening processes, wherein stainless steel is placed in a fusion salt bath containing a mixture of a cyanide salt, a metal halide salt and calcium carbide, wherein the cyanide salt and the metal halide salt are used to activate the passivation layer of stainless steel, and wherein calcium carbide is the carbon source for carburization.

In the abovementioned prior arts, all the gases and salt baths have halides, which are not only expensive but also harmful to human bodies and the environment. Thus, carburization is likely to cause safety problems. Further, halides may corrode piping and equipment and induce stress corrosion cracking. Therefore, the abovementioned methods are unsuitable for industrial application.

SUMMARY OF THE INVENTION

The primary objective of the present invention is to overcome problems of the conventional low-temperature stainless steel carburization methods, including safety problems caused by halide-bearing gases or salt baths, and high fabrication cost caused by expensive halides.

To achieve the abovementioned objective, the present invention proposes a low-temperature stainless steel carburization method, which comprises steps: providing a stainless steel material; placing the stainless steel material at a first temperature ranging from 1050 to 1400° C. in a halogen-free reducing environment; and placing the stainless steel material at a second temperature lower than 600° C. in a carbon-bearing atmosphere to let carbon implant into the surface of the stainless steel material to form a carburized layer.

The low-temperature stainless steel carburization method of the present invention can achieve the following efficacies:

1. The present invention does not use halide-bearing gases or salt baths to activate the passivation layer of the stainless steel but heat-treats the stainless steel in a reducing environment to remove the intrinsic passivation layer and let carbon atoms implant into the surface of the stainless steel to form a carburized layer, whereby greatly simplified the equipment and obviously reduced the fabrication cost.
2. The fact that the present invention does not use halide-bearing gases promotes the fabrication safety and prevents the environment from pollution of halides.

DETAILED DESCRIPTION OF THE PREFERRED EMBODIMENTS

The technical contents of the present invention are described in detail in cooperation with the drawings below.

Figure 1:
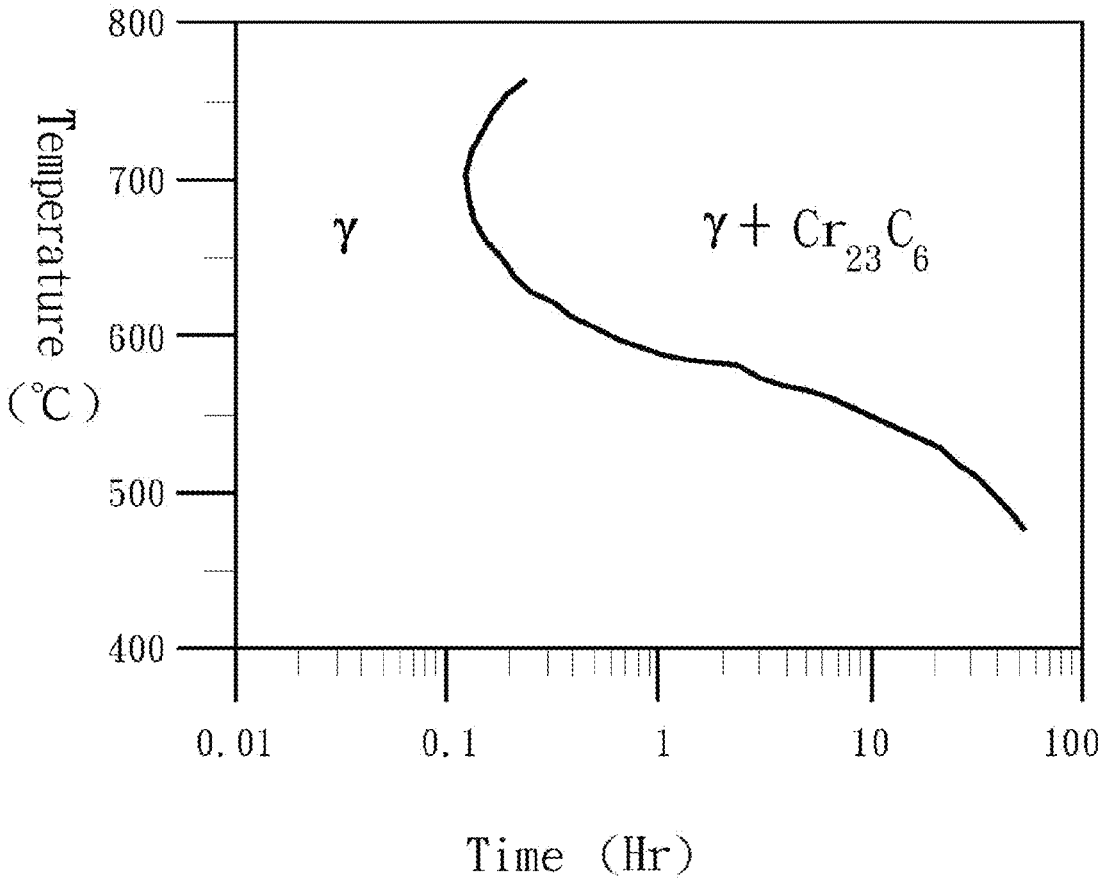
FIG. 1 is a diagram showing a continuous cooling transformation curve of 316L stainless steel.
Figure 2:
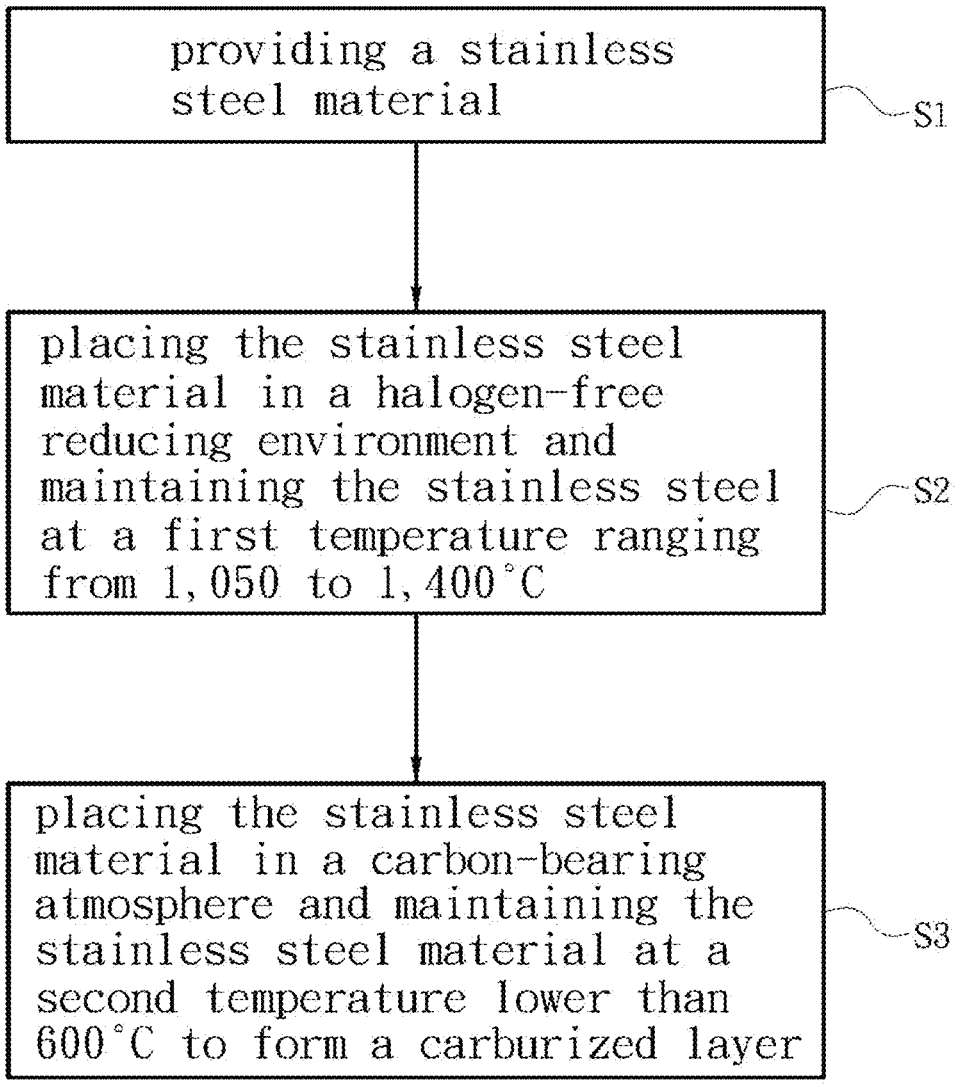
FIG. 2 is a flowchart of a low-temperature stainless steel carburization method according to one embodiment of the present invention.

Refer to FIG. 2 a flowchart of a low-temperature stainless steel carburization method according to one embodiment of the present invention. In Step S1, a provided stainless steel material contains less than 2.0 wt % carbon, less than 1.0 wt % silicon, less than 2.0 wt % manganese, 12.0-19.0 wt % chromium, less than 15.0 wt % nickel, less than 6.0 wt % molybdenum, less than 6.0 wt % copper, with iron being the balance. In one embodiment, the stainless steel material is preferred to meet the chemical composition of 316L, 304L, 440C, or 17-4PH stainless steel. The stainless steel material is a wrought material fabricated with a forging or casting or rolling process. Alternatively, the stainless steel material is a green compact obtained using an MIM (Metal Injection Molding) process or a powder compaction process.

In Step S2, the stainless steel material is placed in a halogen-free reducing environment at a first temperature. The reducing environment may be a vacuum environment or a hydrogen-bearing atmosphere. The hydrogen-bearing atmosphere is preferred in volume percent of hydrogen greater than 5.0%. The first temperature ranges from 1,050 to 1,400° C. Step S2 can be undertaken in an atmosphere sintering furnace or a vacuum furnace. After the stainless steel material is placed in the atmosphere sintering furnace, a gas mixture of hydrogen and nitrogen or cracked ammonia is supplied to the sintering furnace, and the sintering furnace is heated to the first temperature and maintained at the temperature for a predetermined interval of time. Next, the sintering furnace is cooled to the ambient temperature. Then, the stainless steel material is taken out from the sintering furnace. Alternatively, the stainless steel material is placed in a vacuum furnace. The vacuum furnace is pumped to a given degree of vacuum, and the vacuum furnace is heated to the first temperature and maintained at the temperature for a predetermined interval of time. Next, the vacuum furnace is cooled to the ambient temperature. Then, the stainless steel material is taken out from the vacuum furnace. The predetermined interval of time ranges from 30 minutes to 3 hours. When the stainless steel is a green compact formed by an MIM process or a powder compaction process, the green compact will be sintered into a sintered body at the first temperature.

In Step S3, the stainless steel material is in contact with a carbon-bearing atmosphere and maintained at a second temperature to let carbon atoms implant into the surface of the stainless steel material to form a carburized layer. The second temperature is lower than 600° C. and preferably between 400 and 580° C. In the present invention, the carbon-bearing atmosphere is an atmosphere containing carbon monoxide, methane, or propane. In Step S3, the stainless steel material may be placed in a carburizing furnace; the carburizing furnace is heated to a temperature of 400-580° C., and a carbon-bearing atmosphere is supplied to the carburizing furnace; the stainless steel material is maintained at the temperature and carburized for a given interval of time; the carburizing furnace is cooled to the ambient temperature; then, the stainless steel material is taken out from the carburizing furnace. Thereby is formed in the surface of the stainless steel material a carburized layer having a thickness of 10-50 μm. The carburization time is set to be 24 hours preferably. In the present invention, Step S2 and Step S3 are respectively undertaken in an atmosphere sintering furnace/vacuum furnace and a carburizing furnace. Alternatively, Step S2 and Step S3 may be undertaken in the same furnace. For example, after Step S2 is completed, the stainless steel material is not taken out from the furnace, and a carbon-bearing atmosphere is directly supplied to the same furnace to undertake Step S3.

Below, embodiments are used to demonstrate the low-temperature stainless steel carburization method of the present invention. However, the embodiments are only to exemplify the present invention but not to limit the scope of the present invention. Table.1 lists the chemical compositions of the stainless steels used in the embodiments and comparisons, wherein Compositions 1-3 respectively belong to the commercial 316L, 304L and 17-4PH stainless steels, and wherein the stainless steel workpieces used in the embodiments and comparisons are all fabricated using forging process. Herein, stainless steels are only exemplified with the abovementioned stainless steel workpieces. However, the green compacts made of commercial 316L, 304L and 17-4PH stainless steel powders with an MIM process or a powder compaction process may also be used as the samples.

In the embodiments and comparisons, the stainless steel workpieces are carburized according to the fabrication conditions listed in Table.2. After carburization the stainless steel workpieces are examined for the mechanical properties, corrosion resistances, and carburized layer thicknesses of the stainless steel workpieces. The tests of mechanical properties include the surface hardness test and the core hardness test both realized by a Vickers hardness tester. The corrosion resistance tests in the present invention are realized by the MPIF (Metal Powder Industries Federation) Standard 62 and a frequently-used salt-spray method. In the MPIF Standard 62, the carburized workpieces are immersed in a 2 wt % sulfuric acid solution for 24 hours. Then, the weight loss is measured. If the weight loss per square decimeter is less than 0.005 g, the workpiece is a qualified one and designated by O. If the weight loss per square decimeter is greater than 0.005 g, the workpiece is an unqualified one and designated by X. The carburized workpieces are also tested with the salt-spray method, wherein the carburized workpieces are placed in a mist of 5 wt % sodium chloride solution and observed with the naked eyes to determine the interval of time after which corrosion occurs. The carburized layer thickness is measured via observing the microscopic images of the carburized workpieces. The mechanical properties and corrosion resistances of Embodiments I-XI and Comparisons I-III are listed in Table.3.

Embodiment I

Figure 3:
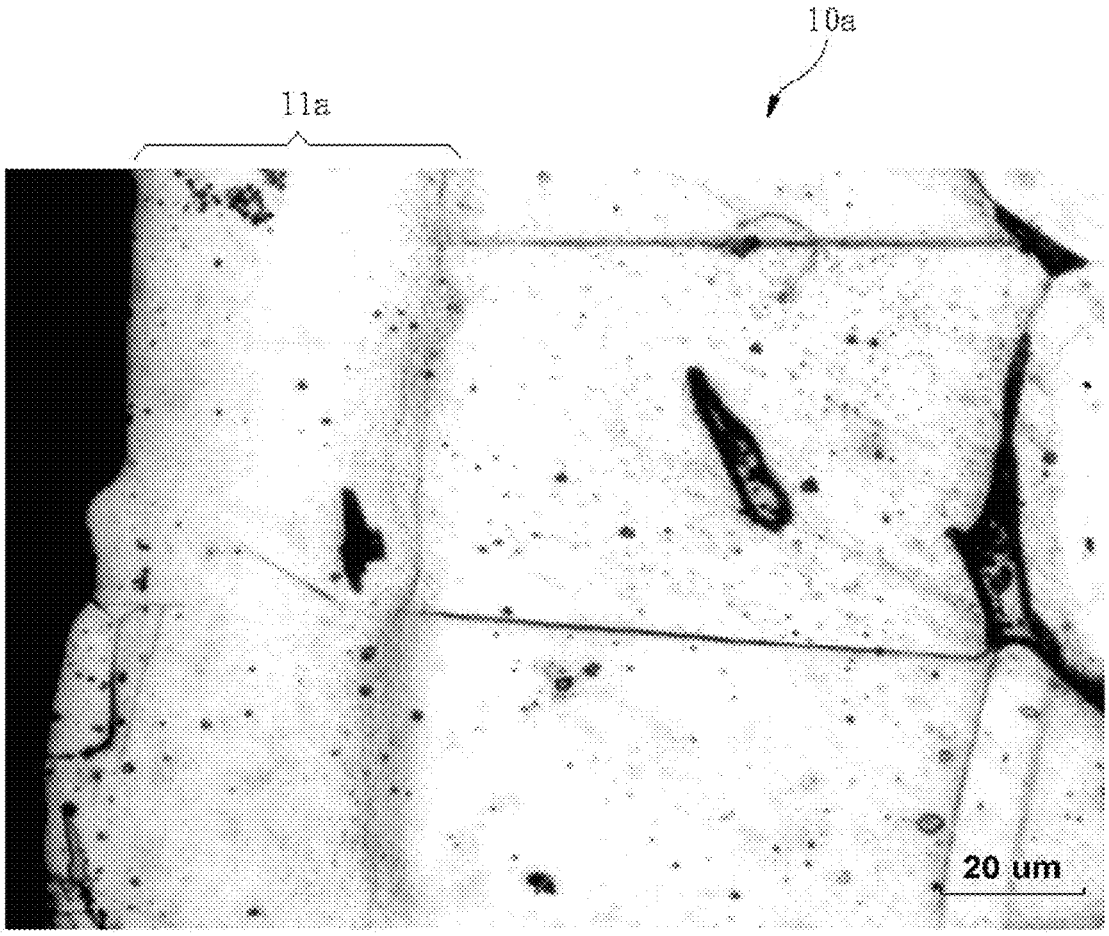
FIG. 3 is an optical microscopic image of the microstructure of a sample used in Embodiment I.

A stainless steel workpiece 10*a* of Composition 1 is used as the sample in this embodiment. The stainless steel workpiece 10*a* is placed in a vacuum furnace and maintained at a temperature of 1350° C. for 2 hours. Next, the stainless steel workpiece 10*a* is taken out from the vacuum furnace and placed in a carburizing furnace, and carbon monoxide is supplied to the carburizing furnace. The stainless steel workpiece 10*a* is carburized at a temperature of 500° C. for 24 hours. The microstructure in FIG. 3 shows that a carburized layer 11*a* having a thickness of about 41 μm is formed on the surface of the stainless steel workpiece 10*a*. The carburized workpiece 10*a* has a surface hardness of about HV805 and a core hardness of about HV122. The carburized workpiece 10*a* has qualified corrosion resistance and can tolerate the salt spray test for 72 hours.

Embodiment II

A stainless steel workpiece of Composition 2 is used as the sample in this embodiment. The stainless steel workpiece is placed in a vacuum furnace and maintained at a temperature of 1,350° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 500° C. for 24 hours. A carburized layer having a thickness of about 40 μm is formed on the surface of the stainless steel workpiece. The carburized workpiece has a surface hardness of about HV800 and a core hardness of about HV120. The carburized workpiece has qualified corrosion resistance and can tolerate the salt spray test for 68 hours.

Embodiment III

A stainless steel workpiece of Composition 1 is used as the sample in this embodiment. The stainless steel workpiece is placed in a vacuum furnace and maintained at a temperature of 1,280° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 500° C. for 24 hours. A carburized layer having a thickness of about 39 μm is formed on the surface of the stainless steel workpiece. The carburized workpiece has a surface hardness of about HV806 and a core hardness of about HV122. The carburized workpiece has qualified corrosion resistance and can tolerate the salt spray test for 72 hours.

Embodiment IV

A stainless steel workpiece of Composition 2 is used as the sample in this embodiment. The stainless steel workpiece is placed in a vacuum furnace and maintained at a temperature of 1,280° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 500° C. for 24 hours. A carburized layer having a thickness of about 40 μm is formed on the surface of the stainless steel workpiece. The carburized workpiece has a surface hardness of about HV800 and a core hardness of about HV120. The carburized workpiece has qualified corrosion resistance and can tolerate the salt spray test for 68 hours.

Embodiment V

A stainless steel workpiece of Composition 1 is used as the sample in this embodiment. The stainless steel workpiece is placed in a vacuum furnace and maintained at a temperature of 1,190° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 500° C. for 24 hours. A carburized layer having a thickness of about 40 μm is formed on the surface of the stainless steel workpiece. The carburized workpiece has a surface hardness of about HV804 and a core hardness of about HV122. The carburized workpiece has qualified corrosion resistance and can tolerate the salt spray test for 72 hours.

Embodiment VI

A stainless steel workpiece of Composition 2 is used as the sample in this embodiment. The stainless steel workpiece is placed in a vacuum furnace and maintained at a temperature of 1,190° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 500° C. for 24 hours. A carburized layer having a thickness of about 38 μm is formed on the surface of the stainless steel workpiece. The carburized workpiece has a surface hardness of about HV803 and a core hardness of about HV120. The carburized workpiece has qualified corrosion resistance and can tolerate the salt spray test for 68 hours.

Embodiment VII

Figure 4:
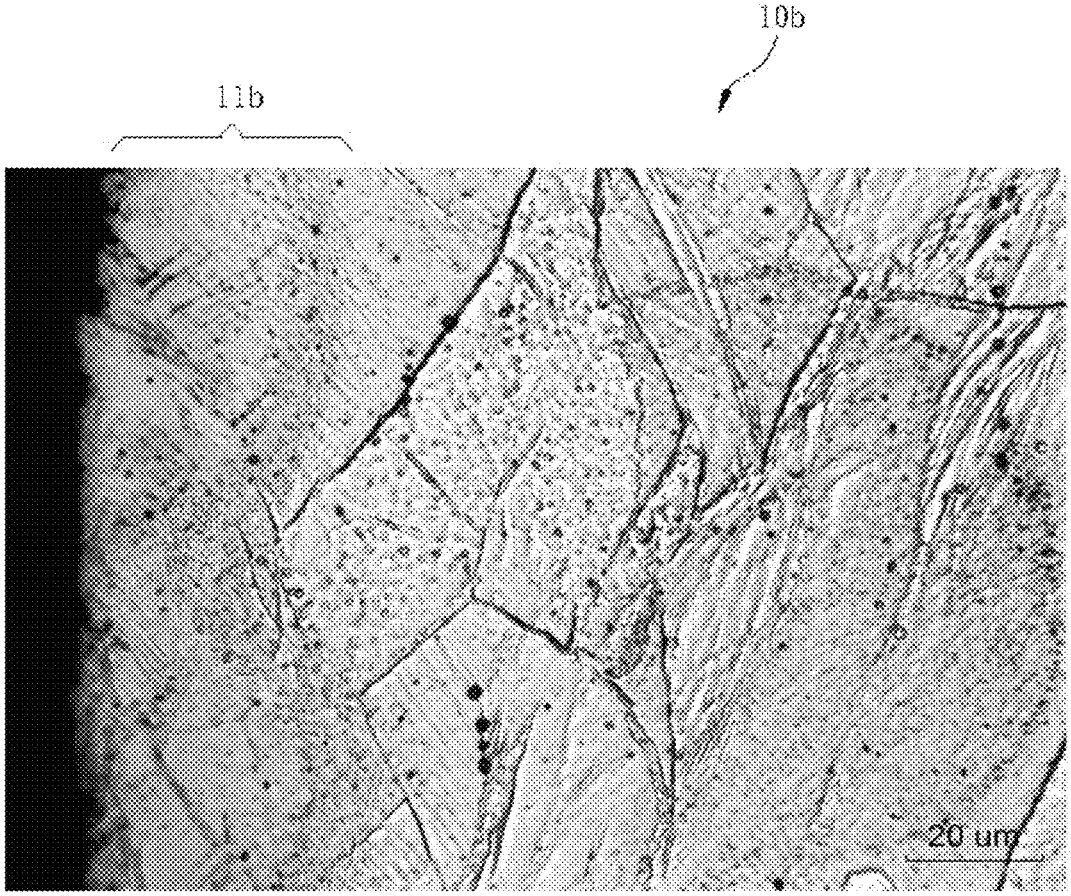
FIG. 4 is an optical microscopic image of the microstructure of a sample used in Embodiment VII.

A stainless steel workpiece 10*b* of Composition 1 is used as the sample in this embodiment. The stainless steel workpiece 10*b* is placed in a carburizing furnace. Hydrogen is supplied to the carburizing furnace, and the stainless steel workpiece 10*b* is maintained at a temperature of 1,120° C. for 2 hours. Next, the temperature of the carburizing furnace is reduced to 500° C., and carbon monoxide is supplied to the carburizing furnace. The stainless steel workpiece 10*b* is carburized at a temperature of 500° C. for 24 hours. The microstructure in FIG. 4 shows that a carburized layer 11*b* having a thickness of about 40 μm is formed on the surface of the stainless steel workpiece 10*b*. The carburized workpiece 10*b* has a surface hardness of about HV805 and a core hardness of about HV122. The carburized workpiece 10*b* has qualified corrosion resistance and can tolerate the salt spray test for 72 hours.

Embodiment VIII

A stainless steel workpiece of Composition 2 is used as the sample in this embodiment. The stainless steel workpiece is placed in a carburizing furnace. Hydrogen is supplied to the carburizing furnace, and the stainless steel workpiece is maintained at a temperature of 1,120° C. for 2 hours. Next, the temperature of the carburizing furnace is reduced to 500° C., and carbon monoxide is supplied to the carburizing furnace. The stainless steel workpiece is carburized at a temperature of 500° C. for 24 hours. A carburized layer having a thickness of about 41 μm is formed on the surface of the stainless steel workpiece. The carburized workpiece has a surface hardness of about HV803 and a core hardness of about HV120. The carburized workpiece has qualified corrosion resistance and can tolerate the salt spray test for 68 hours.

Embodiment IX

A stainless steel workpiece of Composition 1 is used as the sample in this embodiment. The stainless steel workpiece is placed in a vacuum furnace and maintained at a temperature of 1,350° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 400° C. for 24 hours. A carburized layer having a thickness of about 21 μm is formed on the surface of the stainless steel workpiece. The carburized workpiece has a surface hardness of about HV702 and a core hardness of about HV122. The carburized workpiece has qualified corrosion resistance and can tolerate the salt spray test for 72 hours.

Embodiment X

A stainless steel workpiece of Composition 3 is used as the sample in this embodiment. The stainless steel workpiece is placed in a vacuum furnace and maintained at a temperature of 1,320° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 500° C. for 24 hours. A carburized layer having a thickness of about 11 μm is formed on the surface of the stainless steel workpiece. The carburized workpiece has a surface hardness of about HV610 and a core hardness of about HV335. The carburized workpiece has qualified corrosion resistance and can tolerate the salt spray test for 40 hours.

Embodiment XI

A stainless steel workpiece of Composition 3 is used as the sample in this embodiment. The stainless steel workpiece is placed in a vacuum furnace and maintained at a temperature of 1,120° C. for 2 hours. Next, the stainless steel workpiece is taken out from the vacuum furnace and placed in a carburizing furnace, and carbon monoxide is supplied to the carburizing furnace. The stainless steel workpiece is carburized at a temperature of 500° C. for 24 hours. A carburized layer having a thickness of about 12 μm is formed on the surface of the stainless steel workpiece. The carburized workpiece has a surface hardness of about HV610 and a core hardness of about HV320. The carburized workpiece has qualified corrosion resistance and can tolerate the salt spray test for 40 hours.

Comparison I

A stainless steel workpiece 10*c* of Composition 1 is used as the sample in this comparison. The stainless steel workpiece

Figure 5:
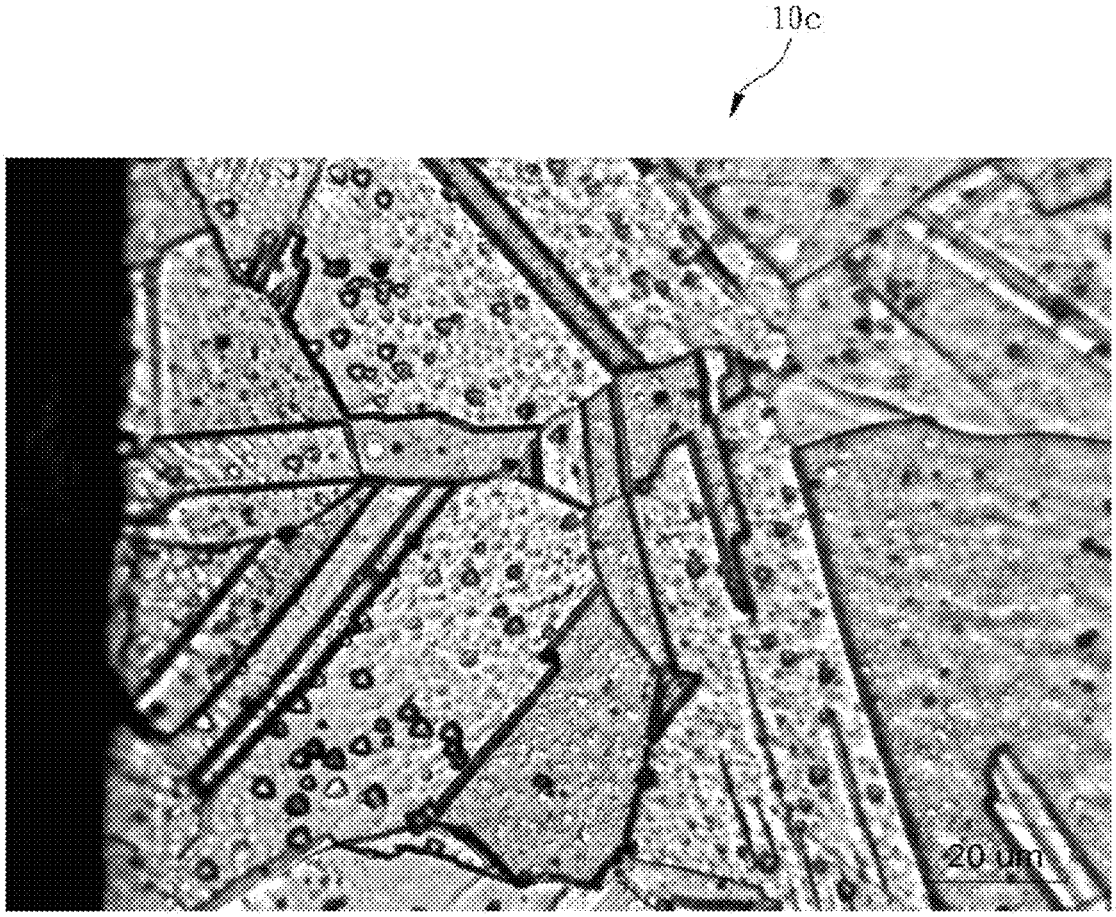
FIG. 5 is an optical microscopic image of the microstructure of a sample used in Comparison I.

10*c* is not pre-treated but directly placed in a carburizing furnace, and carbon monoxide is supplied to the carburizing furnace. The temperature of the carburizing furnace is raised to 500° C. and maintained at this temperature for 24 hours. The microstructure in FIG. 5 shows that no carburized layer is formed on the surface of the stainless steel workpiece 10*c*. The carburized workpiece 10*c* has a surface hardness of about HV120 and a core hardness of about HV120. The workpiece 10*c* has qualified corrosion resistance and can tolerate the salt spray test for 72 hours.

Comparison II

Figure 6:
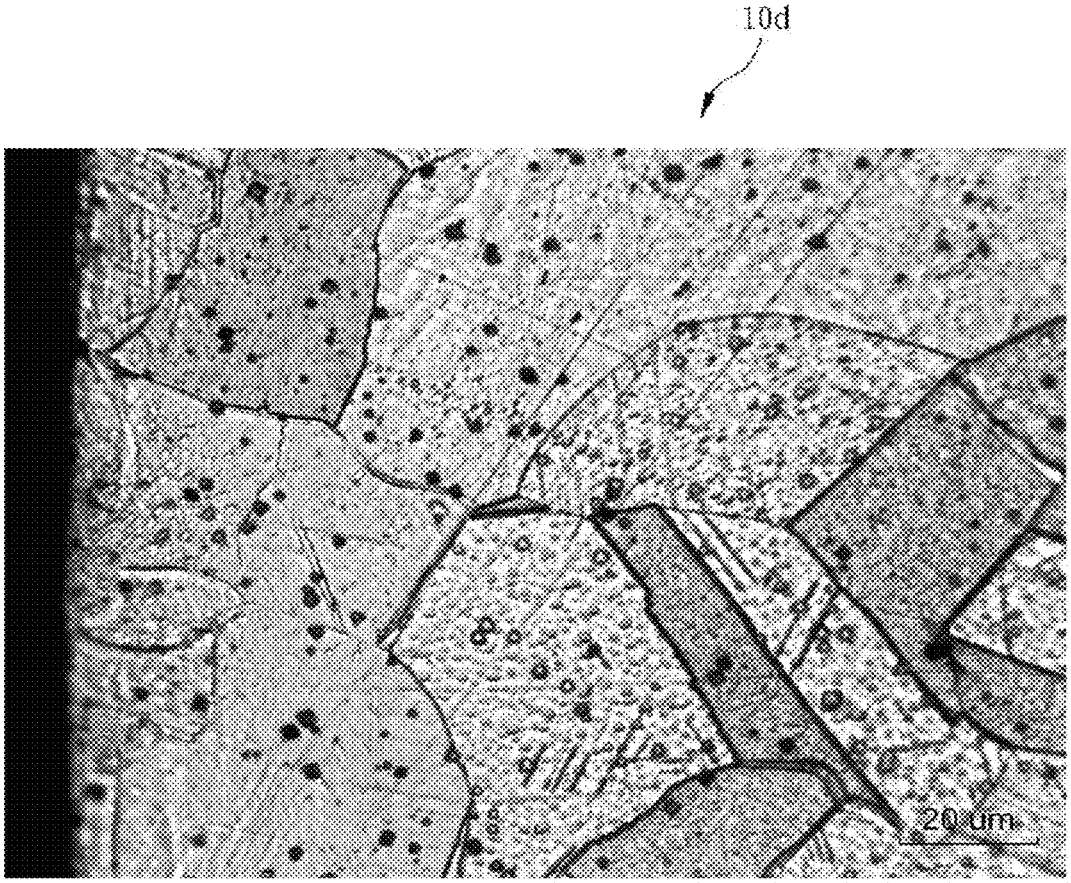
FIG. 6 is an optical microscopic image of the microstructure of a sample used in Comparison II.

A stainless steel workpiece 10*d* of Composition 2 is used as the sample in this comparison. The stainless steel workpiece 10*d* is not pre-treated but directly placed in a carburizing furnace, and carbon monoxide is supplied to the carburizing furnace. The temperature of the carburizing furnace is raised to 500° C. and maintained at this temperature for 24 hours. The microstructure in FIG. 6 shows that no carburized layer is formed on the surface of the stainless steel workpiece 10*d*. The carburized workpiece 10*d* has a surface hardness of about HV121 and a core hardness of about HV122. The carburized workpiece 10*d* has qualified corrosion resistance and can tolerate the salt spray test for 68 hours.

Comparison III

A stainless steel workpiece of Composition 3 is used as the sample in this comparison. The stainless steel workpiece is not pre-treated but directly placed in a carburizing furnace, and carbon monoxide is supplied to the carburizing furnace. The temperature of the carburizing furnace is raised to 500° C. and maintained at this temperature for 24 hours. The carburized workpiece has a surface hardness of about HV322 and a core hardness of about HV325. The carburized workpiece has qualified corrosion resistance and can tolerate the salt spray test for 40 hours.

In Embodiments I-XI, the carburized layer may be as thick as about 41 μm, and the surface hardness is promoted to about HV806 with the corrosion resistance thereof still remaining excellent. In the Comparisons I-III, no carburized layer is formed on the surface of the stainless steel workpiece, and the surface hardness thereof does not increase but still almost equals the core hardness thereof.

In conclusion, the low-temperature stainless steel carburization method of the present invention heat-treats stainless steel in a reducing environment to remove the passivation layer on the surface thereof, and then carburizes the stainless steel in a carbon-bearing atmosphere to form a carburized layer on the surface thereof, whereby promoted the surface hardness of the stainless steel. As carburization is undertaken at a temperature below 600° C. in the present invention, chromium atoms dissolving in stainless steel would not precipitate. Thus, corrosion resistance of stainless steel is preserved. In comparison with the conventional low-temperature stainless steel carburization methods, the present invention does not use a halide-bearing gas or solution to activate the passivation layer. Therefore, the present invention neither harms human bodies nor pollutes the environment. Further, the present invention uses simpler equipment than the conventional methods using a halide-bearing gas or solution. Therefore, the present invention has lower fabrication cost.

The embodiments described above are only to exemplify the present invention but not to limit the scope of the present invention. Any equivalent modification or variation according to the spirit of the present invention is to be also included within the scope of the present invention.

TABLE 1

Chemical Compositions Used in Embodiments and Comparisons (Weight Percentage)

| Serial Number | C | Si | Mn | Cr | Mo | Ni | Cu | Nb | P | S | Fe |
|---|---|---|---|---|---|---|---|---|---|---|---|
| Composition 1 | 0.018 | 0.43 | 1.99 | 19.15 | 2.00 | 10.26 | 0 | 0 | 0.018 | 0.008 | balance |
| Composition 2 | 0.013 | 0.52 | 1.98 | 18.52 | 0 | 9.85 | 0 | 0 | 0.015 | 0.006 | balance |
| Composition 3 | 0.04 | 0.82 | 0.88 | 15.70 | 0.01 | 4.05 | 3.81 | 0.28 | 0.018 | 0.008 | balance |

TABLE 2

Fabrication Conditions for Embodiments I-XI and Comparisons I-III

| Serial Number | Chemical Composition | First Temperature | Reducing Environment | Time | Second Temperature | C-containing Atmosphere | time |
|---|---|---|---|---|---|---|---|
| Embodiment 1 | Composition 1 | 1350° C. | Vacuum | 2 Hours | 500° C. | Carbon Monoxide | 24 Hours |
| Embodiment 2 | Composition 2 | 1350° C. | Vacuum | 2 Hours | 500° C. | Carbon Monoxide | 24 Hours |
| Embodiment 3 | Composition 1 | 1280° C. | Vacuum | 2 Hours | 500° C. | Carbon Monoxide | 24 Hours |
| Embodiment 4 | Composition 2 | 1280° C. | Vacuum | 2 Hours | 500° C. | Carbon Monoxide | 24 Hours |
| Embodiment 5 | Composition 1 | 1190° C. | Vacuum | 2 Hours | 500° C. | Carbon Monoxide | 24 Hours |
| Embodiment 6 | Composition 2 | 1190° C. | Vacuum | 2 Hours | 500° C. | Carbon Monoxide | 24 Hours |
| Embodiment 7 | Composition 1 | 1120° C. | Hydrogen | 2 Hours | 500° C. | Carbon Monoxide | 24 Hours |
| Embodiment 8 | Composition 2 | 1120° C. | Hydrogen | 2 Hours | 500° C. | Carbon Monoxide | 24 Hours |
| Embodiment 9 | Composition 1 | 1350° C. | Vacuum | 2 Hours | 400° C. | Carbon Monoxide | 24 Hours |
| Embodiment 10 | Composition 3 | 1320° C. | Vacuum | 2 Hours | 500° C. | Carbon Monoxide | 24 Hours |

TABLE 2-continued

Fabrication Conditions for Embodiments I-XI and Comparisons I-III

| Serial Number | Chemical Composition | First Temperature | Reducing Environment | Time | Second Temperature | C-containing Atmosphere | time |
|---|---|---|---|---|---|---|---|
| Embodiment 11 | Composition 3 | 1120° C. | Vacuum | 2 Hours | 500° C. | Carbon Monoxide | 24 Hours |
| Comparison 1 | Composition 1 | | Null | | 500° C. | Carbon Monoxide | 24 Hours |
| Comparison 2 | Composition 2 | | Null | | 500° C. | Carbon Monoxide | 24 Hours |
| Comparison 3 | Composition 3 | | Null | | 500° C. | Carbon Monoxide | 24 Hours |

TABLE 3

Hardnesses and Corrosion Resistances Obtained in Embodiments I-XI and Comparisons I-III

| Serial Number | Surface Hardness | Core Hardness | Carburized Depth | Corrosion Resistance Test | Salt Spray Test |
|---|---|---|---|---|---|
| Embodiment 1 | HV 805 | HV 122 | 41 μm | ○ | 72 Hours |
| Embodiment 2 | HV 800 | HV 120 | 40 μm | ○ | 68 Hours |
| Embodiment 3 | HV 806 | HV 122 | 39 μm | ○ | 72 Hours |
| Embodiment 4 | HV 800 | HV 120 | 40 μm | ○ | 68 Hours |
| Embodiment 5 | HV 804 | HV 122 | 40 μm | ○ | 72 Hours |
| Embodiment 6 | HV 803 | HV 120 | 38 μm | ○ | 68 Hours |
| Embodiment 7 | HV 805 | HV 122 | 40 μm | ○ | 72 Hours |
| Embodiment 8 | HV 803 | HV 120 | 41 μm | ○ | 68 Hours |
| Embodiment 9 | HV 702 | HV 122 | 21 μm | ○ | 72 Hours |
| Embodiment 10 | HV 610 | HV 335 | 11 μm | ○ | 40 Hours |
| Embodiment 11 | HV 610 | HV 320 | 12 μm | ○ | 40 Hours |
| Comparison 1 | HV 120 | HV 120 | 0 μm | ○ | 72 Hours |
| Comparison 2 | HV 121 | HV 122 | 0 μm | ○ | 68 Hours |
| Comparison 3 | HV 322 | HV 325 | 0 μm | ○ | 40 Hours |

What is claimed is:

1. A low-temperature stainless steel carburization method comprising steps:

providing a stainless steel material fabricated with a forging process;

placing the stainless steel material in a halogen-free reducing environment and maintaining the stainless steel at a first temperature ranging 1050 to 1400° C.; and placing the stainless steel material in a carbon-bearing atmosphere and maintaining the stainless steel material at a second temperature lower than 600° C. to implant carbon atoms into the stainless steel material to form a carburized layer on the surface of the stainless steel material.

2. The low-temperature stainless steel carburization method according to claim 1, wherein the environment is a vacuum environment or a hydrogen-bearing atmosphere.

3. The low-temperature stainless steel carburization method according to claim 2, wherein the hydrogen-bearing atmosphere contains over 5.0 vol % hydrogen.

4. The low-temperature stainless steel carburization method according to claim 1, wherein the second temperature ranges from 400 to 580° C.

5. The low-temperature stainless steel carburization method according to claim 1, wherein the carburized layer has a thickness of 10-50 μm.

6. The low-temperature stainless steel carburization method according to claim 1, wherein the carbon-bearing atmosphere is selected from a group consisting of carbon monoxide, methane and propane.

7. The low-temperature stainless steel carburization method according to claim 1, wherein the stainless steel material contains less than 2.0 wt % carbon, less than 1.0 wt % silicon, less than 2.0 wt % manganese, 12.0-19.0 wt % chromium, less than 15.0 wt % nickel, less than 6.0 wt % molybdenum, less than 6.0 wt % copper, with iron being the balance.

* * * * *